US005382494A

United States Patent [19]

Kudo et al.

[11] Patent Number: 5,382,494

[45] Date of Patent: Jan. 17, 1995

[54] SILVER HALIDE PHOTOGRAPHIC LIGHT-SENSITIVE MATERIAL HAVING EXCELLENT TRANSPORTING ABILITY

[75] Inventors: Ichiro Kudo; Isamu Michihata; Yasuo Kurachi, all of Hino, Japan

[73] Assignee: Konica Corporation, Japan

[21] Appl. No.: 201,533

[22] Filed: Feb. 25, 1994

[30] Foreign Application Priority Data

Mar. 1, 1993 [JP] Japan ..... 5-040047

[51] Int. Cl.[6] ..... G03C 5/14

[52] U.S. Cl. ..... 430/140; 430/523; 430/527; 430/530; 430/531; 430/930; 428/694 BG; 428/694 BB

[58] Field of Search ..... 430/523, 527, 530, 531, 430/140, 930; 428/694 BG, 694 BB

[56] References Cited

U.S. PATENT DOCUMENTS 4,394,441 7/1983 Kawaguchi et al. ..... 430/530
4,647,501 3/1987 Yamaguchi et al. ..... 428/694 BB
4,999,276 3/1991 Kuwabara et al. ..... 430/527
5,122,445 6/1992 Ishigaki ..... 430/523
5,147,768 9/1992 Sakakibara ..... 430/140
5,294,525 3/1994 Yamauchi et al. ..... 430/523

OTHER PUBLICATIONS

Research Disclosure, No. 1992 Number 343, Item 34390, pp. 869–874, Disclosed Anonymously, Kenneth Mason Publications.

*Primary Examiner*—Thomas R. Neville
*Attorney, Agent, or Firm*—Bierman and Muserlian; Jordan B. Bierman

[57] ABSTRACT

A silver halide photographic light-sensitive material which comprises a backing layer containing inorganic particles is disclosed. The photographic material is exelent in curl-balance suitable for transporting during the processing with automatic processing machine. The photographic material may also comprise a magnetic recording layer on the backing layer so that it is allowed to use as magnetic recording.

9 Claims, No Drawings

SILVER HALIDE PHOTOGRAPHIC LIGHT-SENSITIVE MATERIAL HAVING EXCELLENT TRANSPORTING ABILITY

FIELD OF THE INVENTION

This invention relates to a silver halide photographic light-sensitive material (hereinafter referred to as a light-sensitive material) and, particularly, to a light-sensitive material substantially comprising a transparent backing layer and having both of a curl-balance suitable for transporting the light-sensitive material through a preparation process or an automatic processor and an excellent magnetic recording function in combination.

BACKGROUND OF THE INVENTION

A light-sensitive material, including particularly a photographic light-sensitive material for photographing use (hereinafter referred to as a photographic film), is composed of an insulating plastic-film support provided thereon with a light-sensitive photographic emulsion layer (hereinafter referred to as a light-sensitive layer) and such an auxiliary layer as an antihalation layer, a protective layer, an intermediate layer and a backing layer.

In recent years, the techniques for preparing photographic films have remarkably been improved. Film coating and cutting speeds have been accelerated, and a high-speed automatic processor has also been popularized at photo finishing laboratories. Accordingly, a more speedy manufacture extending to a more speedy use of a photographic film have been studied.

In such a high-speed process, there have been increased instances where photographic films are often scratched and electrostatically charged, by touching with, scraping on or peeling from each other or some other matter.

It is therefore required to improve a photographic film so that the safety and smooth transportation thereof can be performed.

In addition, if an electrostatic prevention is insufficient, a photographic film is fatally affected by a static-mark and is scratched by a dust adhered to the film in the course of transportation. With a photographic film having together with a magnetic-recording function in combination, a spacing-loss is produced by curling the film and a dust is made adhered to the film by an electrostatic charge, so that a recording reproduction may be failed and a noise may be produced. Therefore, any excellent recording reproduction cannot be expected.

It is therefore required, under both dry and wet conditions, that a photographic film is to scarcely be curled, that, even if it should be curled, the curlings in the longitudinal and lateral directions are to be properly balanced and, further, that an antistaticity can be provided thereto.

For keeping the above-mentioned curling balance, there has been such a known technique that an effect can be displayed when adding the particles of a metal oxide or matting agent to a component layer of a photographic film. However, when a large amount of the particles are so added as to keep a curling balance, a sensitivity is spoiled because of a great light-shielding property and an image-sharpness is seriously spoiled because of the granularity of the particles, so that the above-mentioned technique cannot be put into practical use. There has also been a technique for coating gelatin to the opposite side of an emulsion-coated surface.

However, this technique has had such a problem that a layer strength is substantially weak, that a satisfactory antistaticity can hardly be kept while performing the processes from the manufacture to the use without trouble, and, particularly, that the magnetic functions of a photographic film having together with a magnetic-recording function in combination have been often spoiled, and that a reading error has been liable to produce under a low-humidity conditions.

SUMMARY OF THE INVENTION

It is an object of the invention to provide a photographic film capable of solving the above-mentioned problems, keeping a proper curling balance, displaying a durable antistaticity, keeping good transparency with low haze, smoothing an excellent transportability through an apparatus, and performing an excellent and stable magnetic-recording.

A silver halide photographic light-sensitive material of the invention comprises a support having, on one side thereof, a silver halide emulsion layer and, on the other side thereof, a backing layer of which contains inorganic particles comprised of a metal oxide, at least the surface thereof being water-insoluble, in a proportion of 3.5 to 10.0 g/m$^2$ and a binder in a proportion of 75.0 to 660 wt %.

The backing layer is also allowed to contain an organic particles in place of the inorganic particles.

To the backing layer side of the support of each of the above-mentioned silver halide photographic light-sensitive materials, a magnetic layer containing magnetic particles may also be provided.

To each of the supports, a macromolecular resin such as those of a terephthalic acid type polyester or a triacetyl cellulose can preferably be used.

The examples of the terephthalic acid type polyesters include polyethylene terephthalate (alias PET), which may be a copolymer having a principal repetition unit of not less than 85 mols and preferably not less than 90 mols or may also be blended with other polymers, provide that the inherently excellent characteristics of such polyesters cannot be spoiled.

A support comprising triacetyl cellulose is a typical support having an excellent flatness and a readily applicable flexibility.

The inorganic particles to be contained in a backing layer of a photographic film of the invention are metal oxide particles of which at least the surfaces thereof is water-insoluble. More concretely, the whole particle may be consisted of an insoluble metal oxide, or the oxides may also be doped with a small amount of metal in the form of a solid. Further, the particles may also have a core/shell structure in which the shell is comprised of an insoluble metal oxide.

The above-mentioned inorganic particles include, for example, those of an oxide of Zn, Ti, Sn, Al, Si, Mg, Ba, Sb, Ni, Rh, Nb, Ce, Zr, Th or Hf, each of them is water-insoluble and has a material color in white. Among them, the non-toxic and inexpensive are preferable.

The examples of the metal oxides of the inorganic particles include such a stannic oxide colloid as described in Japanese Patent Examined Publication (hereinafter referred to as JP EP) No. 35-6616/1960 and such a metal oxide as described in Japanese Patent Publication Open to Public Inspection (hereinafter referred to as JP OPI Publication) Nos. 51-5300/1976 and 55-12927/1980. Among them, a crystalloidal metal oxide, and those containing an oxygen imperfection and those containing a small amount of a heterogeneous atom capable of forming a donor to a metal oxide are particularly preferable, because the conductivities thereof are generally higher. The latter is more particularly preferable, because any fogginess is produced in a silver halide emulsion. For example, the metal oxides include, preferably, ZnO, $TiO_2$, $SnO_2$, $Al_2O_3$, $In_2O_3$ and $SiO_2$ or the compounded oxides thereof. Among them, ZnO, $TiO_2$ and $SnO_2$ are particularly preferable. As for the examples of those each containing a heterogeneous atom, it is effective to add ZnO with Al or In, $SnO_2$ with Sb, Nb or a halogen atom and $TiO_2$ with Nb or Ta. These heterogeneous atoms may be added in a proportion within the range of, preferably, 0.01 to 30 mol % and, particularly, 0.1 to 10 mol %.

As for the organic particles, those of potyaniline or polypyrrole are preferably used, because they are light in material colors thereof.

The particles applicable to the invention are so coarsely pulverized as to meet the degrees of the raw materials of the particles. Further, they are then pulverized into a medium size to be the order of 10 μm by making use of a roller-crasher. The medium-sized particles are finely pulverized into a size of a micron order so as to assure a transparency required for the photographic films of the invention. If further required, it is preferable to pulverize them into an extra-fine size of a submicron order.

For finely pulverizing and extra-fine pulverizing them, the following pulverizers are used such as a roller-mill, a high-speed rotary pulverizer, a conical ball-mill, a vibrating ball-mill, a jet-mizer and an aungmill. Taking the characteristics for the pulverized material of the above-mentioned particles, the granularity and the transparency in the dispersion stage or the exothermicity produced by the pulverization into consideration, a kind of pulverizing apparatuses is selected out.

In the invention, the granularity of the particles is to be preferably not larger than 1.0 μm and particularly 0.02 to 0.5 μm. It is also preferable to use the powder of pulverized particles upon classifying them to be monodispersive powder having a uniform granularity. When making the powder to be monodispersive, it is advantageous to control the optical characteristics and dispersiveness.

As for the classifier, a dry type classifier is preferably used. A forced vortex type centrifugal separator and an inertial classifier are preferable for the levels required for the invention.

It is also allowed to use core-/shell type particles coated on the surfaces thereof with $SnO_2$ or the like.

The binders applicable to a backing layer include, for example, a thermoplastic resin, a radioactively setting resin, a thermosetting resin and other reactive type resin. They may be used independently or in combination. The following resins may be used for the backing layer containing an inorganic or organic particles as well as a magnetic layer provided on the backing layer.

The above-mentioned thermoplastic resins include, for example, a vinyl type polymer or the copolymer thereof such as a vinyl chloride-vinyl acetate copolymer, a vinyl chloride resin, a vinyl acetate resin, a vinyl acetate-vinyl alcohol copolymer, a partially hydrolyzed vinyl chloride-vinyl acetate copolymer, a vinyl chloride-vinylidene chloride copolymer, a vinyl chloride-acrylonitrile copolymer, an ethylene-vinyl alcohol copolymer, a chlorinated polyvinyl chloride, an ethylene-vinyl chloride copolymer and an ethylene-vinyl acetate copolymer; a cellulose derivative such as nitrocellulose, cellulose acetate, cellulose acetate propionate and cellulose acetate butylate; a rubber type resin such as a copolymer of maleic acid and/or acrylic acid, an acrylic acid ester copolymer, an acrylonitrile-styrene copolymer, a chlorinated polyethylene, an acrylonitrile-chlorinated polyethylene-styrene copolymer, a methyl methacrylate-butadiene-styrene copolymer, an acryl resin, a polyvinyl acetal resin, a polyvinyl butyral resin, a polyester polyurethane resin, a polyether polyurethane resin, a polycarbonate polyurethane resin, a polyester resin, a polyether resin, a polyamide resin, an amino resin, a styrene-butadiene resin and a butadiene-acrylonitrile resin; a silicone resin; and a fluororesin.

The above-mentioned thermoplastic resins are to have a Tg within the range of −40° C. to 180° C. and preferably 30° C. to 150° C., and a weight average molecular weight within the range of, preferably 5,000 to 300,000 and, more preferably, 10,000 to 200,000.

They may be ordinarily used in the form of a solvent type or aqueous type emulsion, or an aqueous type colloidal solution. The above-mentioned synthetic resin type emulsions may be used when they have a particle size within the range of 5 nm to 2 μm.

The radioactively setting resins are those to be set by radioactive rays, such as electronic rays and ultraviolet rays. They include, for example, a solvent type or an aqueous type emulsions, such as those of a maleic anhydride type, a urethaneacrylic type, an etheracrylic type and an epoxyacrylic type.

The thermosetting resins and other reactive type resins include, for example, a solvent type or a water-soluble type emulsion such as those of a phenol resin, an epoxy resin, a polyurethane setting type resin, a urea resin, an alkyd resin and a silicone setting type resin.

The above-given binders may have a polar group in the molecules thereof. The polar groups thereof include, for example, an epoxy group, —COOM, —OH, $—NR_2$, $—NR_3X$, $—SO_3M$, $—PO_3M_2$, and $PO_3M$ (in which M represents a hydrogen atom, an alkali-metal or ammonium; X represents an acid capable of forming an amine salt; and R represents a hydrogen atom or an alkyl group.)

Besides the above, hydrophilic binders applicable to the invention include, for example, a water-soluble polymer, a cellulose ether, a latex polymer and a water-soluble polyester, each described in Research Disclosure, No. 17643, p. 26 and, ibid., No. 18716, p. 651.

The water-soluble polymers include, besides the above, gelatin, a gelatin derivative, casein, agar, sodium alginate, starch, polyvinyl alcohol, an acrylic acid type copolymer and a maleic anhydride copolymer. The cellulose ethers include, for example, methyl cellulose, carboxymethyl cellulose, hydroxyethyl cellulose and hydroxypropyl cellulose. The typically preferable examples thereof include nitrocellulose and diacetyl cellulose.

When making use of a water-soluble polymer, it is preferable to make combination use of a layer hardener. The layer hardeners applicable thereto include, for example, the following compounds; namely, an aldehyde type compound such as formaldehyde and glutar aidehyde; a ketone compound such as diacetyl and cyclopentanedione; a compound having an reactive halogen, such as bis(2-chloroethyl urea), 2-hydroxy-4,6-dichloro-1,3,5-triazine and those described in U.S. Pat. Nos. 3,288,775 and 2,732,303 and British Patent Nos.

974,723 and 1,167,207; a compound having an active olefin, such as divinyl sulfone, 5-acetyl-1,3-diacryloyl hexahydro-1,3,5-triazine and those described in U.S. Pat. Nos. 3,635,718 and 3,232,763 and British Patent No. 994,869; an N-methylol compound such as N-hydroxymethyl phthalimide and those described in U.S. Pat. Nos. 2,732,316 and 2,586,168; an iso cyanate such as those described in U.S. Pat. No. 3,103,437; an aziridine compound such as those described in U.S. Pat. Nos. 3,017,280 and 2,983,611; an acid derivative such as those described in U.S. Pat. Nos. 2,725,293 and 2,725,295; an epoxy compound such as those described in U.S. Pat. No. 3,091,537; and a halogen carboxy aldehyde such as mucochloric acid. Further, an inorganic type layer hardeners may also be used and they include, for example, chrome alum and zirconium sulfate. Besides the above, there also include a carboxyl group-activation type layer hardeners such as those described in JP Examined Publication Nos. 56-12853/1981 and 58-32699/1983, Belgian Patent No. 825,726, JP OPI Publication Nos. 60-225148/1985 and 51-126125/1976, JP Examined Publication No. 58-50699/1983, JP OPI Publication No. 52-54427/1977, and U.S. Pat. No. 3,321,313.

The above-mentioned layer hardeners may be use ordinarily in a proportion within the range of 0.01 to 60% by weight to a resin solid used and, preferably, 0.05 to 50% by weight.

On backing side of the photographic material a magnetic layer may be provided to be used for magnetic recording purpose. Magnetic powder may be contained in the backing layer containing an inorganic or organic particles, so that the resulting photographic films can be used for magnetic recording purpose. The magnetic layer is provided preferably on the backing layer containing an inorganic or organic particles.

As for the magnetic particles applicable to a magnetic recording, a magnetic ferrite is preferable. The magnetic ferrites include, for example, magnetite (or $Fe_3O_4$), magnehematite (or $\gamma$-$Fe_2O_3$), Co-denatured-$\gamma$-$Fe_2O_3$, barium ferrite, or $CrO_2$, iron nitride, iron carbide and metallic iron. The magnetic reluctance of the magnetic particles is preferably within the range of 200 to 3000 Oe.

With magnetic iron oxide and Co-denatured magnetic iron oxide, the contents of such a preferable magnetic material as mentioned above are to be preferably not less than 5%, more preferably not less than 10% and further preferably not less than 15%. For preparing a transparent magnetic-recording layer, it is preferable to make a particle size as smaller as possible. The specific surface area thereof is to be preferably not narrower than 20 $m^2/g$ and particularly not narrower than 30 $m^2/g$, in terms of S BET. Any configurations thereof may be taken, however, a needle-shaped configuration is preferable. The ratio of the needle-shaped configurations is preferably within the range of 5 to 15.

If a ferromagnetic fine-powder content per $m^2$ of a transparent support is too little, the objective magnetic properties cannot be produced. Therefore, the content thereof is to be not less than $4\times10^{-3}$ g, preferably not less than $10^{-2}$ g and more preferably not less than $4\times10^{-2}$ g. If the content thereof is too much, it is preferable to set an average transmission density to be not higher than 0.5, because the aforementioned average transmission density is made higher so that the sensitivity of the photographic characteristics may be lowered.

In the case that the photographic material comprises a magnetic layer on the backing layer, such an oxide as In, Mo, Ir, W, V or Pb, each of which have a deep material color, may also be used as the above-mentioned inorganic particles in the backing layer.

As for the binders of a magnetic layer, polyester, polyurethane, a vinyl chloride-vinyl acetate copolymer or cellulose may be used. The typically preferable examples thereof include nitrocellulose and diacetyl cellulose. Inorganic or organic particles and/or magnetic powder are mixed in a cyclohexanone solution, a methylethyl ketone solution or a toluene solution, and the resulting mixture is so kneaded as to be dispersed by making use of a kneading equipment such as a roll-mill, a sand-grinder and a disper-kneader. The viscosity of the resulting dispersion is controlled with a solvent, so that a coating composition can be prepared.

If required in this case, it is also allowed to add a dispersant such as lecithin, higher alcohol and a sulfosuccinic acid ester to the coating composition. It is preferable that the magnetic powder is preliminarily treated with a dispersant before kneading the magnetic powder.

After the magnetic layer is coated, it is then orientation-treated by applying a magnetic field.

An antistatic agent such as the following UL-1 and UL-2 is contained in a sublayer on the side of an emulsion layer, and a water-soluble conductive-polymer is contained in a sublayer on the side of a backing layer. Thereby, a sublayer having an antistatic function is formed, so that a durable staticity can preferably be provided in the course extending from the manufacture, then the use to the post-use.

It is also allowed to make combination use of a generally applicable antistatic agent in the other component layers of a photographic film.

UL-1

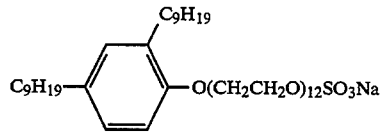

UL-2

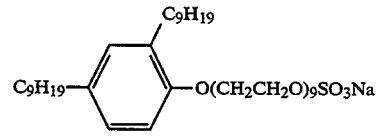

UL-4

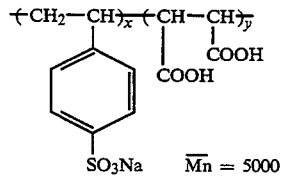

$\overline{Mn}$ = 5000 x:y = 75:25 (in ratio by weight)

The photographic characteristics of a black-and-white or color emulsion are controlled by adding various kinds of additives popularly used, and the resulting emulsion is used by singly or multiply coating on a photographic film. For example, an amount of gelatin, an amount of a layer hardener, the sizes of solid particles, such as those of a silver halide, capable of serving as a binder-enhancing nucleus, an oil drop functionable of relaxing a stress, an amount of latex and a finished layer-thickness are each a factor relating to a curling of a photographic film. These factors may be referred to the control of the methods for making use of the particles of a backing layer. A particle content of a backing layer is preferably within the range of 3.5 to 10.0 g/m$^2$.

A photographic film of the invention has at least one silver halide emulsion layer on one side thereof and at least one backing layer on the other side thereof. The silver halide emulsion layer and an antistatic layer may be coated on opposite side for photographic support. The silver halide emulsion layer may be coated through an antistatic layer on a photographic support. On the silver halide emulsion layer, a hydrophilic colloidal layer may also be coated as a protective layer. The silver halide emulsion layer may be separated into two or more layers having the different speeds from each other; namely, a high-speed silver halide emulsion layer and a low-speed silver halide emulsion layer. An inter layer, a filter layer and so forth may also be interposed between each of the silver halide emulsion layers. A non-light-sensitive hydrophilic colloidal layer such as an interlayer, a protective layer and an antihalation layer may further be interposed between a silver halide emulsion layer and a protective layer. It is preferable to coat a silver halide emulsion layer after coating a backing layer.

As for a silver halide applicable to a silver halide emulsion, a silver halide emulsion having any composition may be used. For example, they may include silver chloride, silver chlorobromide, silver chloroiodobromide, pure silver bromide and silver iodobromide.

The silver halide emulsions may also contain a sensitizing dye, a plasticizer, an antistatic agent, a surfactant, a layer hardener and so forth.

The photographic material of the invention has good transparency with low haze. Haze is estimated by means of turbidity. The turbidity of the photographic material of the invention is preferably not more than 15% as a whole and more preferably 10%.

In a developing process of a photographic film of the invention, it is allowed to use a developer such as those described in, for example, T. H. James, "The Theory of The Photographic Process", 4th Edition, pp.291–334, and "Journal of the American Chemical Society", Vol. 73, p.3,100, (1951).

EXAMPLES

Now, the concrete examples of the invention will be detailed.

EXAMPLE 1

(1) Photographic Film for General Use (1)-1 Preparation of a Backing Layer Coating Material After the coating materials having compositions 1 through 12 each shown in Table 1 were each stirred for 10 minutes by making use of a magnetic stirrer and were then dispersed for 10 minutes by making use of a lateral type sand-grinder (Model HM-10 manufactured by Inoue Mfg. Works, Ltd. ). Thereafter, the resulting dispersions were diluted with a solvent and were then filtrated, so that coating materials 1 through 12 could be prepared.

(1)-2 Preparation of Backing Layer Coating Material

After the backing layer coating material having composition 1 shown in Table 1 was stirred for 10 minutes and was then diluted with a solvent. Thereafter, the resulting dilution was filtrated, so that coating material 13 could be prepared.

TABLE 1

| | | | | (Coating material composition for backing layer 1) Amount used (in part by weight) | | | | | | | | |
|---|---|---|---|---|---|---|---|---|---|---|---|---|
| No | Coating material Composition | Powder | Binder | Powder -1 | Powder -2 | Binder | Cyclo-hexanone | Methyl-ethyl ketone | Toluene | Acetone | Ethyl acetate | Water |
| 1 | 1 | A | a | 15.0 | 0.0 | 5.0 | 24.0 | 24.0 | 32.0 | 0.0 | 0.0 | 0.0 |
| 2 | 2 | B | a | 15.0 | 0.0 | 5.0 | 24.0 | 24.0 | 32.0 | 0.0 | 0.0 | 0.0 |
| 3 | 3 | C | a | 15.0 | 0.0 | 5.0 | 24.0 | 24.0 | 32.0 | 0.0 | 0.0 | 0.0 |
| 4 | 4 | A | a | 8.6 | 0.0 | 11.4 | 24.0 | 24.0 | 32.0 | 0.0 | 0.0 | 0.0 |
| 5 | 5 | A | a | 34.7 | 0.0 | 5.3 | 18.0 | 18.0 | 24.0 | 0.0 | 0.0 | 0.0 |
| 6 | 6 | A | b | 15.0 | 0.0 | 5.0 | 0.0 | 0.0 | 32.0 | 24.0 | 24.0 | 0.0 |
| 7 | 7 | A | c | 15.0 | 0.0 | 5.0 | 0.0 | 0.0 | 0.0 | 0.0 | 0.0 | 80.0 |
| 8 | 8 | A | a | 35.0 | 0.0 | 5.0 | 18.0 | 18.0 | 24.0 | 0.0 | 0.0 | 0.0 |
| 9 | 9 | A | a | 6.7 | 0.0 | 13.3 | 24.0 | 24.0 | 32.0 | 0.0 | 0.0 | 0.0 |
| 10 | 10 | D | a | 15.0 | 0.0 | 5.0 | 24.0 | 24.0 | 32.0 | 0.0 | 0.0 | 0.0 |
| 11 | 11 | A, D | a | A = 10.0 | D = 5.0 | 5.0 | 28.5 | 28.5 | 38.0 | 0.0 | 0.0 | 0.0 |
| 12 | 12 | E | a | 15.0 | 0.0 | 5.0 | 24.0 | 24.0 | 32.0 | 0.0 | 0.0 | 0.0 |
| 13 | 1 | A | a | 15.0 | 0.0 | 5.0 | 24.0 | 24.0 | 32.0 | 0.0 | 0.0 | 0.0 |

Powder A $SnO_2$ (Sb dopant) having an average particle size of 0.05 μm
Powder B $TiO_2$ ($SnO_2$ type coat) having an average particle size of 0.5 μm
Powder C $BaSO_4$ ($SnO_2$ type coat) having an average particle size of 0.2 μm
Powder D Polypyrrole powder
Powder E Polyaniline powder
Binder a Nitrocellulose
Binder b Diacetyl cellulose
Binder c Ossein gelatin Next, with the composition shown in Table 2, wax was dissolved in a solvent and the resulting solution was filtrated, so that coating material (1) for backing layer 2 could be prepared.

TABLE 2

| Composition of coating material (1) for backing layer 2: | |
|---|---|
| Composition | Amount used (in part by weight) |
| Carnauba wax | 0.1 |
| Toluene | 99.9 |

(1)-3 Preparation of Film Base

With each of PET (polyethylene terephthalate) bases so biaxially stretched as to have a thickness of 100 μm, the back side thereof was corona-discharged, and the coating materials 1 through 13 for backing layer 1 prepared in (1)-1 and 2 were so coated as to have the powder-coating weights shown in Table 4 and dried up. After each of the resulting coated and dried base was corona-discharged again and coated with coating material (1) for backing layer 2 and dried, the resulting coated and dried bases were treated by heat for 5 minutes at 140° C., so that film bases 1 through 15 could be prepared. With a TAC (triacetyl cellulose) base so prepared as to have a thickness of 120 μm, the back side thereof was corona-discharged, and coating material (6) for backing layer 1 prepared in (1)-1 was so coated as to have a powder-coating weight shown in Table 4 and dried up. After the resulting coated and dried base was corona-discharged again and coated with coating material (1) for backing layer 2 and dried up. Thereafter, the coated and dried base was treated by heat for 5 minutes at 140° C., so that film base 16 could be prepared.

(1)-4 Preparation of Photographic Light-sensitive Material

A corona-discharge was treated on the opposite side of the backing layer of each of film bases 1 through 16 prepared as in the above, so that multilayered color photographic light-sensitive materials each comprising the emulsion layer arrangements described in Example 1 given in JP Application No. 4-267697/1992, and these light-sensitive material are herein named 1 through 16, respectively.

In the multilayered emulsion layers, the gelatin contents were 13.7 g, the contents of 0.3–0.4 μm sized and 0.7–0.8 μm sized silver halide grains were 2.3 g, the amounts of oil-drops were 2.8 g and the layer thicknesses were 27 μm, respectively.

Evaluation of Film Bases

Film bases 1 through 16 prepared as above were developed in the following processing steps and with the developer having the following composition, and the resulting processed film bases were evaluated before and after processing them in the following procedures. The results thereof are shown in Table 4.

| | |
|---|---|
| Color developing | 3 min. 15 sec. |
| Bleaching | 6 min. 30 sec. |
| Washing | 2 min. 10 sec. |
| Fixing | 4 min. 20 sec. |
| Washing | 3 min. 15 sec. |
| Stabilizing | 1 min. 05 sec. |

The compositions of the processing solutions used in the processing steps were as follows.

| | |
|---|---|
| Color developer | |
| Diethylenetriamine pentacetic acid | 1.0 g |
| 1-hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-ethyl-N-b-hydroxyethylamino)-2-methylaniline sulfate | 4.5 g |
| Add water to make | 1.01 |
| | pH 10.0 |
| Bleacher | |
| Ferric ammonium ethylenediamine tetracetate | 100.0 g |
| Disodium ethylenediamine tetracetate | 10.0 g |
| Ammonium bromide | 150.0 g |
| Ammonium nitrate | 10.0 g |
| Add water to make | 1.01 |
| | pH 6.0 |
| Fixer | |

-continued

| | |
|---|---|
| Disodium ethylenediamine tetracetate | 1.0 g |
| Sodium sulfite | 4.0 g |
| Ammonium thiosulfate (in a 70% solution) | 175.0 mg |
| Sodium bisulfite | 4.6 g |
| Add water to make | 1.01 |
| | pH 6.6 |
| Stabilizer | |
| Formalin (in a 40% solution) | 2.0 mg |
| Polyoxyethylene-p-monononylphenyl ether, (having an average polymerization degree of 10) | 0.3 g |
| Add water to make | 1.01 |

Evaluation of Photographic Light-sensitive Materials

The prepared photographic light-sensitive materials 1 through 18 were spliced by making use of a film splicer (Model PS-35-2 manufactured by Noritsu Koki Co., Ltd.) and they were then ordinarily developed through an automatic film-developing machine (Model NCV 60 manufactured by Noritsu Koki Co., Ltd.). Thereafter, they were evaluated in the following procedures. The results thereof are shown in Table 5.

Procedures of Evaluation

1) Optical density

By making use of a Sakura densitometer, Model PDA-65 manufactured by Konica Corp. and an interference filter capable of transmitting blue rays of light, light having a specific wavelength was made incident vertically to a subject coated layer, so that light absorbed by the coated layer was calculated out.

2) Turbidity

By making use of a digital densitometer, Model T-2600D manufactured by Ikeda Rika Co., light is made incident from the light-source of a 12 V, 20 W halogen lamp to a subject coated layer, so that the resulting scattering degrees were calculated out in a total haze white method.

3) Conductivity

A subject sample was cut into a size of 35 mm in width by 70 mm in length and the cut piece was then stored under a relative humidity of 10% RH for 10 hours. Thereafter, a pair of electrodes were so brought into contact with the back side of the sample as to apply an electric current to the back side thereof, so that the resulting surface electric resistance was measured.

4) Static mark test

After an unexposed sample was stored for 6 hours under the conditions of 25° C. and 10% RH, the sample was pulled out at a speed of 4 m/sec., in a darkroom under the same air-condition, from the cartridge thereof comprising polyethylene containing 5% by weight of carbon black and a urethane-made material. The naked unexposed sample was developed with the foregoing developer, fixed and then washed. With the resulting developed sample, the resulting static mark production was checked up.

The evaluation of the static marks was carried out in the following three grades.

A: No static mark produced at all;

B: A few static marks produced; and

C: Static marks considerably produced.

5) Dust adhesion test

Under the conditions of 25° C. and RH10%, the subject unexposed samples (in a 20 cm×20 cm size) before processed and those after processed were pulled out of the foregoing cartridge comprising polyethylene and polyurethane at a speed of 4 m/sec. Immediately after pulling it out, a cigarette ash adhesion to the sample was checked up. The evaluation thereof was carried out by the following three grades.

A: No ash-adhesion produced at all;

B: A few ash-adhesion produced; and

C: Serious ash-adhesion produced.

6) Curling

A subject sample was so cut as to have a width of 35 mm to the longitudinal direction and, further, it was cut by 1 to 2 mm to the longitudinal direction. The resulting cut pieces of the sample was stored for 50 hours under the conditions of 25° C., RH10% and 90%, and then the curvature thereof was checked up.

7) Test for Transporting Samples Through an Automatic Processor

Each of a prepared photographic light-sensitive material was cut into a size of 35 mm in width and 120 cm in length. Each of the resulting cut pieces thereof was wound around a reel core having a diameter of 10.8 mm so as to face the emulsion surface inwards. Each of the rolled cut pieces was then heat-treated for 4 hours under the conditions of 55° C. and 20% RH. Thereafter, each of the cut pieces was released from the reel core. Each of the naked cut pieces was spliced together by making use of a film splicer used popularly on the market (such as Model PS-35-2 manufactured by Noritsu Koki Co., Ltd.) and was then ordinarily developed through an automatic film processor (such as Model NCV60 manufactured by Noritsu Koki Co., Ltd.). Thereafter, the evaluation was carried out by the following three grades.

A: No crease nor scratch of film produced;

B: Scratches of film produced; and

C: Crease of film produced.

EXAMPLE 2

(2) Magnetic-recording Photographic Film (2)-1 Preparation of Backing Layer Coating Material As for the coating material for backing layer 1, coating material 1 described in the above-mentioned (1)-1 was used. The backing layer 2 was prepared in quite the same manner as in the descriptions of (1)-1, except that the following composition of backing layer 2 was used therein.

TABLE 3

| Composition of coating material (2) for backing layer 2: | |
|---|---|
| Composition | Weight used (in part by weight) |
| Magnetic powder* | 0.5 |
| Nitrocellulose | 14.5 |
| Cyclohexanone | 25.5 |
| Methylethyl ketone | 25.5 |

TABLE 3-continued

| Composition of coating material (2) for backing layer 2: | |
|---|---|
| Composition | Weight used (in part by weight) |
| Toluene | 34.0 |

*Magnetic powder
BET (specific surface area) 35 $m^2/g$
He (Magnetic reluctance) 650 Oe
Co-γ-$Fe_2O_3$ As the coating material for backing layer 3, coating material (1) for backing layer 2 described in Table 2 was used as it was.

(2)-2 Preparation of Film Base

With a polyethylene 2,6-naphthalate base biaxially stretched to have a thickness of 80 μm, the back side thereof was corona-discharged. The coating material for backing layer 1, that was prepared in the manner described in (1)-1, was so coated as to have a powder-coated amount shown in Table 4 and dried up. Then, a corona-discharge was treated again, and coating material (2) for backing layer 2 was so coated as to have a powder-coated amount shown in Table 4 and dried up. Further, a corona-discharge was treated thereon, and coating material (1) for backing layer 2 was coated to serve as backing layer 3 and dried up. Thereafter, a heat-treatment was applied at 140° C. for 5 minutes, so that film base 17 was prepared. Film base samples No. 18 through No. 37 were prepared in the similar manner as shown in Table 6.

(2)-3 Preparation of Photographic Film

On an opposite side to the backing layer of the obtained film base no. 17 to No. 37, photographic emulsion layers same as Example 1 are provided in the same way. Resulted samples are called as Samples No. 17 to No. 37.

(2)-4 Evaluation of Film Base and Photographic Film

The same evaluation in Example 1 and a test for magnetic recording characteristics mentioned below are conducted. The results are summarized in Tables 6 and 7.

Evaluation of Magnetic-recording Output Error

Each of the photographic films was once magnetically inputted from the backing layer thereof in magnetic tracks CO to C3 by means of the signal input system disclosed in International Publication No. 90-04205 under the conditions of 25° C. and 55% RH before developing it. After each of the resulting films was developed, the output operations were repeated 500 times by a magnetic head under the conditions of 25° C. and 10% RH, 25° C. and 55% RH and 25° C. and 90% RH, respectively. The resulting number of times of the errors was checked up. The term, an "error", herein means a number of samples resulting at least one bit giving output level of relatively less than 70% where the average of output level tested before the development processing is regarded as 100%.

TABLE 4

| | | Backing 1st layer | | | Before making development | | | | After making development | | | |
|---|---|---|---|---|---|---|---|---|---|---|---|---|
| | Film base | Coating material for backing layer 1 | Amount of powder used ($g/m^2$) | Thickness (μm) | Optical density | Turbidity (%) | Conductivity (Ω/sq) | Dust-adhesion | Optical density | Turbidity (%) | Conductivity (Ω/sq) | Dust-adhesion |
| Inv. | 1 | 1 | 3.5 | 1.7 | 0.04 | 2.0 | 1.5 E + 06 | A | 0.05 | 1.9 | 2.3 E + 06 | A |
| Inv. | 2 | 1 | 7.0 | 3.4 | 0.05 | 3.0 | 4.8 E + 05 | A | 0.05 | 3.1 | 4.6 E + 05 | A |

TABLE 4-continued

| | Film base | Backing 1st layer: Coating material for backing layer 1 | Backing 1st layer: Amount of powder used (g/m²) | Backing 1st layer: Thickness (μm) | Before making development: Optical density | Before making development: Turbidity (%) | Before making development: Conductivity (Ω/sq) | Before making development: Dust-adhesion | After making development: Optical density | After making development: Turbidity (%) | After making development: Conductivity (Ω/sq) | After making development: Dust-adhesion |
|---|---|---|---|---|---|---|---|---|---|---|---|---|
| Inv. | 3 | 1 | 10.0 | 4.8 | 0.06 | 3.5 | 3.2 E + 05 | A | 0.06 | 3.4 | 3.3 E + 05 | A |
| Inv. | 4 | 2 | 4.0 | 2.2 | 0.04 | 3.1 | 6.7 E + 06 | A | 0.05 | 3.1 | 6.7 E + 06 | A |
| Inv. | 5 | 3 | 4.0 | 2.1 | 0.04 | 4.5 | 3.6 E + 07 | A | 0.04 | 4.1 | 3.5 E + 07 | A |
| Inv. | 6 | 4 | 4.0 | 5.9 | 0.04 | 3.3 | 3.4 E + 06 | A | 0.04 | 3.4 | 3.5 E + 06 | A |
| Inv. | 7 | 5 | 4.0 | 1.2 | 0.04 | 3.2 | 2.8 E + 06 | A | 0.05 | 3.3 | 2.9 E + 06 | A |
| Inv. | 8 | 6 | 4.0 | 1.9 | 0.04 | 3.5 | 5.5 E + 06 | A | 0.05 | 3.5 | 5.3 E + 06 | A |
| Inv. | 9 | 7 | 4.0 | 1.9 | 0.04 | 3.8 | 6.3 E + 06 | A | 0.04 | 3.7 | 6.5 E + 06 | A |
| Comp. | 10 | 8 | 12.0 | 3.4 | 0.08 | 8.5 | 2.9 E + 05 | A | 0.08 | 8.2 | 3.1 E + 05 | A |
| Comp. | 11 | 9 | 2.0 | 4.3 | 0.03 | 2.2 | 7.7 E + 10 | B | 0.03 | 2.2 | 8.1 E + 10 | B |
| Inv. | 12 | 10 | 3.5 | 3.1 | 0.05 | 2.3 | 2.4 E + 06 | A | 0.05 | 2.2 | 2.7 E + 06 | A |
| Inv. | 13 | 11 | 3.5 | 2.0 | 0.05 | 2.7 | 2.3 E + 06 | A | 0.05 | 2.6 | 3.3 E + 06 | A |
| Inv. | 14 | 12 | 3.5 | 3.1 | 0.06 | 2.5 | 3.1 E + 06 | A | 0.05 | 2.8 | 2.9 E + 06 | A |
| Comp. | 15 | 13 | 3.5 | 1.8 | 0.08 | 23.5 | 1.8 E + 06 | A | 0.09 | 31.7 | 2.5 E + 06 | A |
| Inv. | 16 | 6 | 4.0 | 1.9 | 0.04 | 3.9 | 5.2 E + 06 | A | 0.04 | 3.9 | 5.5 E + 06 | A |

TABLE 5

| | Photo light-sensitive material | Backing 1st layer: Coating material for backing layer 1 | Backing 1st layer: Amount of powder used (g/m²) | Thickness (μm) | Curling (l/m): RH10% | Curling (l/m): RH90% | Transporta test through automatic processor | Static-mark test |
|---|---|---|---|---|---|---|---|---|
| Invention | 1 | 1 | 3.5 | 1.7 | 8 | −2 | A | A |
| Invention | 2 | 1 | 7.0 | 3.4 | 6 | −3 | A | A |
| Invention | 3 | 1 | 10.0 | 4.8 | 4 | −7 | A | A |
| Invention | 4 | 2 | 4.0 | 2.2 | 6 | −4 | A | A |
| Invention | 5 | 3 | 4.0 | 2.1 | 7 | −3 | A | A |
| Invention | 6 | 4 | 4.0 | 5.9 | −4 | −10 | A | A |
| Invention | 7 | 5 | 4.0 | 1.2 | 11 | 7 | A | A |
| Invention | 8 | 6 | 4.0 | 1.9 | −1 | −6 | A | A |
| Invention | 9 | 7 | 4.0 | 1.9 | 1 | 0 | A | A |
| Comparative | 10 | 8 | 12.0 | 3.4 | 26 | 19 | C | A |
| Comparative | 11 | 9 | 2.0 | 4.3 | −13 | −17 | B | B |
| Invention | 12 | 10 | 3.5 | 3.1 | 9 | −2 | A | A |
| Invention | 13 | 11 | 3.5 | 2.0 | 4 | −6 | A | A |
| Invention | 14 | 12 | 3.5 | 3.1 | 9 | −4 | A | A |
| Comparative | 15 | 13 | 3.5 | 1.8 | 10 | −4 | A | A |
| Invention | 16 | 6 | 4.0 | 1.9 | 12 | −6 | A | A |

TABLE 6

| | Film base | Backing 1st layer: Coating material for backing layer 1 | Backing 1st layer: Amount of powder used (g/m²) | Backing 1st layer: Thickness (μm) | Backing 2nd layer Amount of magnetic powder used (mg/m²) | Before making development: Optical density | Before making development: Turbidity (%) | Before making development: Conductivity (Ω/sq) | Before making development: Dust-adhesion | After making development: Optical density | After making development: Turbidity (%) | After making development: Conductivity (Ω/sq) | After making development: Dust-adhesion |
|---|---|---|---|---|---|---|---|---|---|---|---|---|---|
| Inv. | 17 | 1 | 3.5 | 1.7 | 100.0 | 0.15 | 5.8 | 8.3 E + 08 | A | 0.15 | 5.8 | 8.2 E + 08 | A |
| Inv. | 19 | 1 | 7.0 | 3.4 | 100.0 | 0.15 | 6.1 | 4.8 E + 07 | A | 0.15 | 6.1 | 7.6 E + 07 | A |
| Inv. | 20 | 1 | 10.0 | 4.8 | 100.0 | 0.14 | 7.6 | 3.2 E + 06 | A | 0.14 | 7.7 | 5.3 E + 06 | A |
| Comp. | 21 | 1 | 2.0 | 1.0 | 100.0 | 0.14 | 7.9 | 3.2 E + 11 | B | 0.14 | 7.9 | 5.0 E + 11 | B |
| Comp. | 22 | 1 | 12.0 | 5.8 | 100.0 | 0.16 | 15.8 | 2.2 E + 06 | A | 0.16 | 16.8 | 2.2 E + 06 | A |
| Inv. | 23 | 2 | 3.5 | 2.0 | 100.0 | 0.15 | 8.2 | 6.7 E + 08 | A | 0.15 | 8.1 | 6.7 E + 08 | A |
| Inv. | 24 | 3 | 3.5 | 2.0 | 100.0 | 0.14 | 8.0 | 3.6 E + 09 | A | 0.14 | 8.3 | 8.4 E + 09 | A |
| Inv. | 25 | 4 | 3.5 | 5.2 | 100.0 | 0.15 | 6.1 | 3.5 E + 09 | A | 0.15 | 7.8 | 8.4 E + 09 | A |
| Inv. | 26 | 5 | 3.5 | 1.1 | 100.0 | 0.14 | 6.9 | 3.0 E + 07 | A | 0.14 | 7.0 | 3.3 E + 07 | A |
| Inv. | 27 | 6 | 3.5 | 1.6 | 100.0 | 0.15 | 7.8 | 6.0 E + 07 | A | 0.15 | 8.4 | 8.5 E + 07 | A |
| Inv. | 28 | 7 | 3.5 | 1.6 | 100.0 | 0.15 | 10.5 | 1.5 E + 09 | B | 0.15 | 12.0 | 2.5 E + 09 | B |
| Comp. | 29 | 8 | 7.0 | 2.1 | 100.0 | 0.15 | 23.5 | 3.29 E + 09 | B | 0.15 | 25.8 | 5.5 E + 10 | B |
| Comp. | 30 | 8 | 12.0 | 3.5 | 100.0 | 0.18 | 36.8 | 3.3 E + 08 | A | 0.15 | 29.8 | 9.3 E + 06 | A |
| Comp. | 31 | 9 | 7.0 | 14.0 | 100.0 | 0.16 | 19.5 | 4.90 E + 11 | C | 0.16 | 20.6 | 5.5 E + 11 | C |
| Comp. | 18 | 9 | 2.0 | 4.3 | 100.0 | 0.14 | 8.5 | 4.8 E + 13 | C | 0.14 | 8.0 | 9.4 E + 13 | C |
| Inv. | 32 | 10 | 3.5 | 3.1 | 100.0 | 0.15 | 14.5 | 5.2 E + 08 | A | 0.15 | 14.5 | 7.3 E + 08 | A |
| Inv. | 33 | 11 | 3.5 | 2.0 | 100.0 | 0.16 | 13.2 | 9.2 E + 08 | A | 0.16 | 14.1 | 6.3 E + 08 | A |
| Inv. | 34 | 12 | 3.5 | 3.1 | 100.0 | 0.14 | 12.3 | 7.3 E + 08 | A | 0.14 | 9.8 | 6.3 E + 08 | A |
| Comp. | 35 | 13 | 3.5 | 1.8 | 100.0 | 0.16 | 22.9 | 1.5 E + 10 | A | 0.16 | 31.7 | 9.2 E + 10 | A |
| Inv. | 36 | 1 | 4.0 | 1.9 | 40.0 | 0.09 | 4.2 | 6.5 E + 07 | A | 0.09 | 4.6 | 7.6 E + 07 | A |
| Inv. | 37 | 1 | 4.0 | 1.9 | 15.0 | 0.07 | 4.1 | 6.1 E + 07 | A | 0.07 | 4.1 | 7.0 E + 07 | A |

TABLE 7

| | Photo sensitive material | Backing 1st layer: Coating material for backing layer 1 | Backing 1st layer: Amount of powder used ($g/m^2$) | Backing 1st layer: Thickness ($\mu m$) | Backing 2nd layer: Amount of magnetic powder used ($mg/m^2$) | Curling (l/m) RH10% | Curling (l/m) RH90% | Transportation test through automatic processor | Static-mark test | Magnetic recording output error RH10% | Magnetic recording output error RH55% | Magnetic recording output error RH90% |
|---|---|---|---|---|---|---|---|---|---|---|---|---|
| Inv. | 17 | 1 | 3.5 | 1.7 | 100.0 | 7 | −8 | A | A | 0 | 2 | 0 |
| Inv. | 19 | 1 | 7.0 | 3.4 | 100.0 | 6 | −3 | A | A | 0 | 0 | 0 |
| Inv. | 20 | 1 | 10.0 | 4.8 | 100.0 | 4 | −15 | A | A | 0 | 0 | 0 |
| Comp. | 21 | 1 | 2.0 | 1.0 | 100.0 | 35 | 10 | B | C | 256 | 25 | 56 |
| Comp. | 22 | 1 | 12.0 | 5.8 | 100.0 | 0 | −26 | B | A | 3 | 10 | 195 |
| Inv. | 23 | 2 | 3.5 | 2.0 | 100.0 | 6 | −4 | A | A | 1 | 0 | 0 |
| Inv. | 24 | 3 | 3.5 | 2.0 | 100.0 | 5 | −3 | A | A | 1 | 0 | 0 |
| Inv. | 25 | 4 | 3.5 | 5.2 | 100.0 | −4 | −1 | A | A | 0 | 0 | 0 |
| Inv. | 26 | 5 | 3.5 | 1.1 | 100.0 | 14 | 7 | A | A | 0 | 0 | 0 |
| Inv. | 27 | 6 | 3.5 | 1.6 | 100.0 | 5 | −6 | A | A | 1 | 0 | 0 |
| Inv. | 28 | 7 | 3.5 | 1.6 | 100.0 | 12 | 5 | B | B | 9 | 2 | 8 |
| Comp. | 29 | 8 | 7.0 | 2.1 | 100.0 | 0 | −15 | B | B | 185 | 38 | 56 |
| Comp. | 30 | 8 | 12.0 | 3.5 | 100.0 | −6 | −38 | C | A | 12 | 18 | 246 |
| Comp. | 31 | 9 | 7.0 | 14.0 | 100.0 | 28 | 15 | B | B | 300 | 26 | 100 |
| Comp. | 18 | 9 | 2.0 | 4.3 | 100.0 | 48 | 19 | C | C | 155 | 23 | 60 |
| Inv. | 32 | 10 | 3.5 | 3.1 | 100.0 | 12 | −2 | A | A | 5 | 2 | 0 |
| Inv. | 33 | 11 | 3.5 | 2.0 | 100.0 | 10 | −6 | A | A | 3 | 2 | 0 |
| Inv. | 34 | 12 | 3.5 | 3.1 | 100.0 | 16 | −4 | A | A | 6 | 2 | 0 |
| Comp. | 35 | 13 | 3.5 | 1.8 | 100.0 | 10 | −4 | A | A | 43 | 12 | 25 |
| Inv. | 36 | 1 | 4.0 | 1.9 | 40.0 | 5 | 0 | A | A | 0 | 0 | 0 |
| Inv. | 37 | 1 | 4.0 | 1.9 | 15.0 | 8 | 2 | A | A | 3 | 3 | 3 |

When dispersing the particles of the invention in a specific dispersion method, a film base having an excellent transparency can be provided and a silver halide photographic light-sensitive material excellent in transportability through an automatic processor and capable of performing a stable magnetic-recording.

We claim:

1. A silver halide photographic light-sensitive material comprising a support, a silver halide emulsion layer on one side thereof and a backing layer on the other side thereof, a magnetic recording layer on said backing layer, wherein said backing layer contains inorganic particles comprised of a metal oxide at least a surface thereof being water-insoluble, said inorganic particles being dispersed in a binder in an amount of 3.5 to 10.0 $g/m^2$ and in a proportion of 75.0% to 660% by weight based on said binder.

2. A silver halide photographic light-sensitive material of claim 1 wherein the binder is selected from the group consisting of nitrocellulose, diacetyl cellulose, and mixtures thereof.

3. A silver halide photographic light-sensitive material of claim 1 wherein particle size of the inorganic particle is not larger than 1.0 $\mu m$.

4. A silver halide photographic light-sensitive material of claim 3 wherein particle size of the inorganic particle is 0.02 to 0.5 $\mu m$.

5. A silver halide photographic light-sensitive material of claim 1 wherein particle size of the inorganic particle is not larger than 1.0 $\mu m$.

6. A silver halide photographic light-sensitive material of claim 5 wherein particle size of the inorganic particle is 0.02 to 0.5 $\mu m$.

7. A silver halide photographic light-sensitive material of claim 1 wherein the inorganic particle is a metal oxide.

8. A silver halide photographic light-sensitive material of claim 1 wherein turbidity of the photographic material is not more than 15% as a whole.

9. A silver halide photographic light-sensitive material of claim 1 wherein turbidity of the photographic material is not more than 10% as a whole.

* * * * *